US006865981B2

(12) United States Patent
Wiechers et al.

(10) Patent No.: US 6,865,981 B2
(45) Date of Patent: Mar. 15, 2005

(54) METHOD OF PRODUCING A PUMP

(75) Inventors: Jonathan T. Wiechers, Defiance, OH (US); Stephen D. Able, Bryan, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 23 days.

(21) Appl. No.: 10/386,036

(22) Filed: Mar. 11, 2003

(65) Prior Publication Data

US 2004/0177750 A1 Sep. 16, 2004

(51) Int. Cl.[7] ..... F16J 3/00
(52) U.S. Cl. ..... 92/98 R
(58) Field of Search ..... 92/98 R, 99; 29/888.02

(56) References Cited

U.S. PATENT DOCUMENTS

| | | | | |
|---|---|---|---|---|
| 2,381,544 | A | | 5/1945 | Jacobsen |
| 2,952,218 | A | | 9/1960 | Steffes |
| 3,385,174 | A | | 5/1968 | Crosland |
| 3,604,822 | A | * | 9/1971 | Saxe ..... 417/339 |
| 3,643,700 | A | | 2/1972 | Black |
| 4,337,797 | A | | 7/1982 | Caruso |
| 4,403,539 | A | | 9/1983 | Motoki et al. |
| 4,448,063 | A | | 5/1984 | Mudge et al. |
| 4,576,200 | A | | 3/1986 | Janecke et al. |
| 4,740,202 | A | | 4/1988 | Stacey et al. |
| 4,795,448 | A | | 1/1989 | Stacey et al. |
| 4,830,586 | A | | 5/1989 | Herter et al. |
| 4,872,816 | A | | 10/1989 | Fetcko |
| 4,936,753 | A | | 6/1990 | Kozumplik, Jr. et al. |
| 4,978,283 | A | | 12/1990 | Vonalt |
| 5,108,270 | A | | 4/1992 | Kozumplik, Jr. |
| 5,129,427 | A | * | 7/1992 | White et al. ..... 417/540 |
| 5,222,425 | A | | 6/1993 | Davies |
| 5,269,664 | A | | 12/1993 | Buse |
| D347,639 | S | | 6/1994 | Fast et al. |
| 5,334,003 | A | | 8/1994 | Gardner et al. |
| 5,345,965 | A | | 9/1994 | Blume |
| 5,366,351 | A | | 11/1994 | Nolte |
| 5,391,060 | A | | 2/1995 | Kozumplik, Jr. et al. |
| 5,409,040 | A | | 4/1995 | Tomlin |
| 5,450,987 | A | | 9/1995 | Nolte |
| D370,488 | S | | 6/1996 | Kozumplik, Jr. et al. |
| 5,551,847 | A | | 9/1996 | Gardner et al. |
| 5,559,310 | A | | 9/1996 | Hoover et al. |
| 5,584,666 | A | | 12/1996 | Kozumplik, Jr. et al. |
| 5,634,391 | A | | 6/1997 | Eady |
| 5,647,737 | A | | 7/1997 | Gardner et al. |
| 5,649,809 | A | * | 7/1997 | Stapelfeldt ..... 92/100 |
| 5,649,813 | A | | 7/1997 | Able et al. |
| 5,664,940 | A | | 9/1997 | Du |
| 5,687,633 | A | | 11/1997 | Eady |
| D388,796 | S | | 1/1998 | Conti et al. |
| D388,797 | S | | 1/1998 | Conti et al. |
| 5,711,658 | A | | 1/1998 | Conti et al. |
| 5,733,253 | A | | 3/1998 | Headley et al. |
| 5,737,920 | A | | 4/1998 | Able |
| 5,848,615 | A | | 12/1998 | Conti et al. |

(List continued on next page.)

*Primary Examiner*—Thomas E. Lazo
(74) *Attorney, Agent, or Firm*—Michael Best & Friedrich LLP

(57) ABSTRACT

A pump having a diaphragm positioned within a diaphragm housing comprised of an air cap and a fluid cap. The air cap and fluid cap include inner surfaces that cooperate to define a diaphragm chamber in which the diaphragm moves between a withdrawn deformed position and an extended deformed position. The inner surfaces of the air cap and fluid cap are designed to fully accommodate the movement of the diaphragm between its withdrawn deformed position and an extended deformed position. Finite element analysis is used to estimate the diaphragm's withdrawn deformed position and an extended deformed position.

15 Claims, 3 Drawing Sheets

U.S. PATENT DOCUMENTS 5,848,878 A 12/1998 Conti et al.
5,885,239 A 3/1999 Headley et al.
5,893,490 A 4/1999 Gnyp
5,894,784 A 4/1999 Bobbitt, III et al.
5,905,212 A 5/1999 Moses et al.
5,951,259 A 9/1999 Gardner et al.
5,951,267 A 9/1999 Piercey et al.
6,019,742 A 2/2000 Headley et al.
6,039,711 A 3/2000 Headley et al.
6,065,389 A 5/2000 Riedlinger
6,074,335 A 6/2000 Headley et al.
6,099,491 A 8/2000 Headley et al.
6,109,300 A 8/2000 Najmolhoda
6,113,359 A 9/2000 Watts et al.
6,142,749 A 11/2000 Jack et al.
6,145,430 A 11/2000 Able et al.
6,168,387 B1 1/2001 Able et al.
6,190,136 B1 2/2001 Meloche et al.
6,230,609 B1 5/2001 Bender et al.
6,257,845 B1 7/2001 Jack et al.
6,280,149 B1 8/2001 Abl et al.
6,299,173 B1 10/2001 Lai
6,299,413 B1 10/2001 Stahlman et al.
6,363,894 B1 4/2002 Barkman
6,558,141 B2 5/2003 Vonalt et al.
6,602,179 B1 8/2003 Headley et al.
6,644,941 B1 11/2003 Able et al.
D484,145 S 12/2003 Roberts et al.
6,722,256 B2 4/2004 Roberts et al.
2001/0051569 A1 12/2001 Headley
2003/0110939 A1 6/2003 Able et al.
2003/0125182 A1 7/2003 Headley et al.
2003/0198560 A1 10/2003 Able et al.
2004/0018053 A1 1/2004 Starry, Jr. et al.
2004/0047748 A1 3/2004 Roberts et al.
2004/0047749 A1 3/2004 Roberts et al.
2004/0050242 A1 3/2004 Roberts et al.
2004/0069140 A1 4/2004 Able et al.

* cited by examiner

METHOD OF PRODUCING A PUMP

BACKGROUND

The present invention relates to pumps and more particularly to air-operated diaphragm pumps. Conventional air-operated diaphragm pumps typically include a diaphragm positioned within a diaphragm chamber surrounded by a diaphragm housing. The diaphragm housing is comprised of an air cap and a fluid cap that cooperate to form the diaphragm housing. The diaphragm chamber is comprised of two separate chambers: an air chamber and a fluid chamber. On one side of the diaphragm, between the air cap and the diaphragm, the air chamber is formed. Air is alternatingly supplied and evacuated from the air chamber to drive the diaphragm back and forth. On the other side of the diaphragm, between the diaphragm and the fluid cap, the fluid chamber is formed, through which a fluid to be pumped flows as the diaphragm moves back and forth. In conventional pumps, the air cap and fluid cap are typically formed with inner surfaces of a constant radius or other simple shape. The diaphragm is often coupled to one end of a piston, which may be coupled on its other end to a second diaphragm in a double-diaphragm arrangement.

SUMMARY OF THE INVENTION

In conventional air-operated diaphragm pumps, the shape of the inner surfaces of the air cap and the fluid cap are designed such that the diaphragm may unintentionally contact either of the inner surfaces at the extent of its stroke or leave unwanted space between one of the inner surfaces and the diaphragm at the extent of its stroke. Contact between the diaphragm and one of the surfaces of the diaphragm housing can cause wear and fatigue of the diaphragm. Unwanted space between the inner surface of the air cap or fluid cap and the diaphragm can reduce efficiency of the pump. A diaphragm housing that is designed with a shape to reduce contact between the diaphragm and the inner surfaces of the air cap and fluid cap and reduce the space between the inner surfaces of the air cap and fluid cap and the diaphragm at the extent of its stroke would be welcomed by users of air-operated diaphragm pumps.

According to the present invention, a method of producing a pump comprises selecting a diaphragm, determining the extent to which the diaphragm will deform when pressurized in a diaphragm chamber of a pump, and designing the diaphragm chamber to house the diaphragm based on determining the extent to which the diaphragm will deform.

Additional features and advantages of the invention will become apparent to those skilled in the art upon consideration of the following detailed description exemplifying the best mode of carrying out the invention as presently perceived.

BRIEF DESCRIPTION OF THE DRAWINGS

The detailed description particularly prefers to accompanying figures in which.

DETAILED DESCRIPTION

Figure 1:
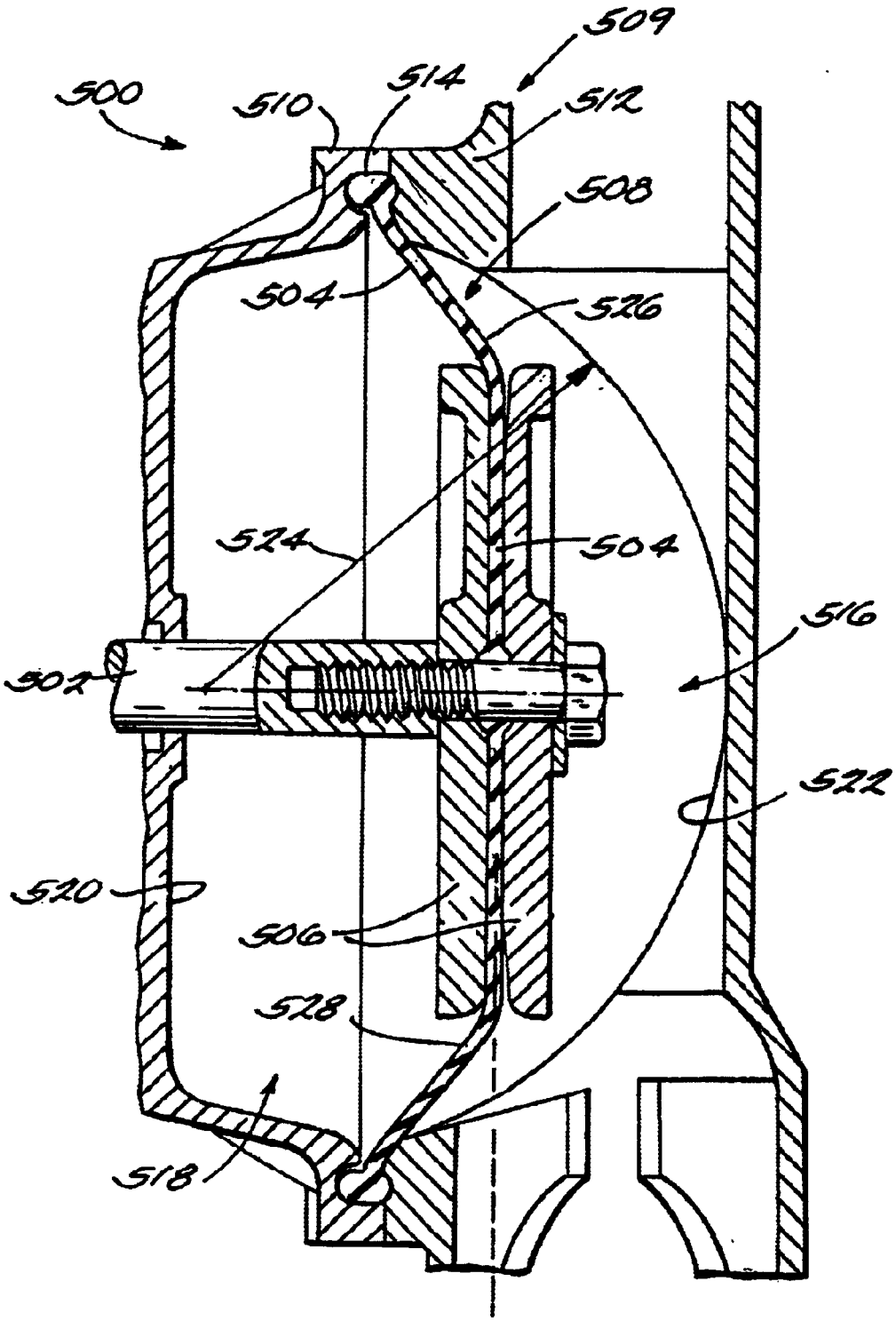
FIG. 1 illustrates a diaphragm chamber of a conventional air-operated diaphragm pump with a diaphragm in an extended position.
Figure 2:
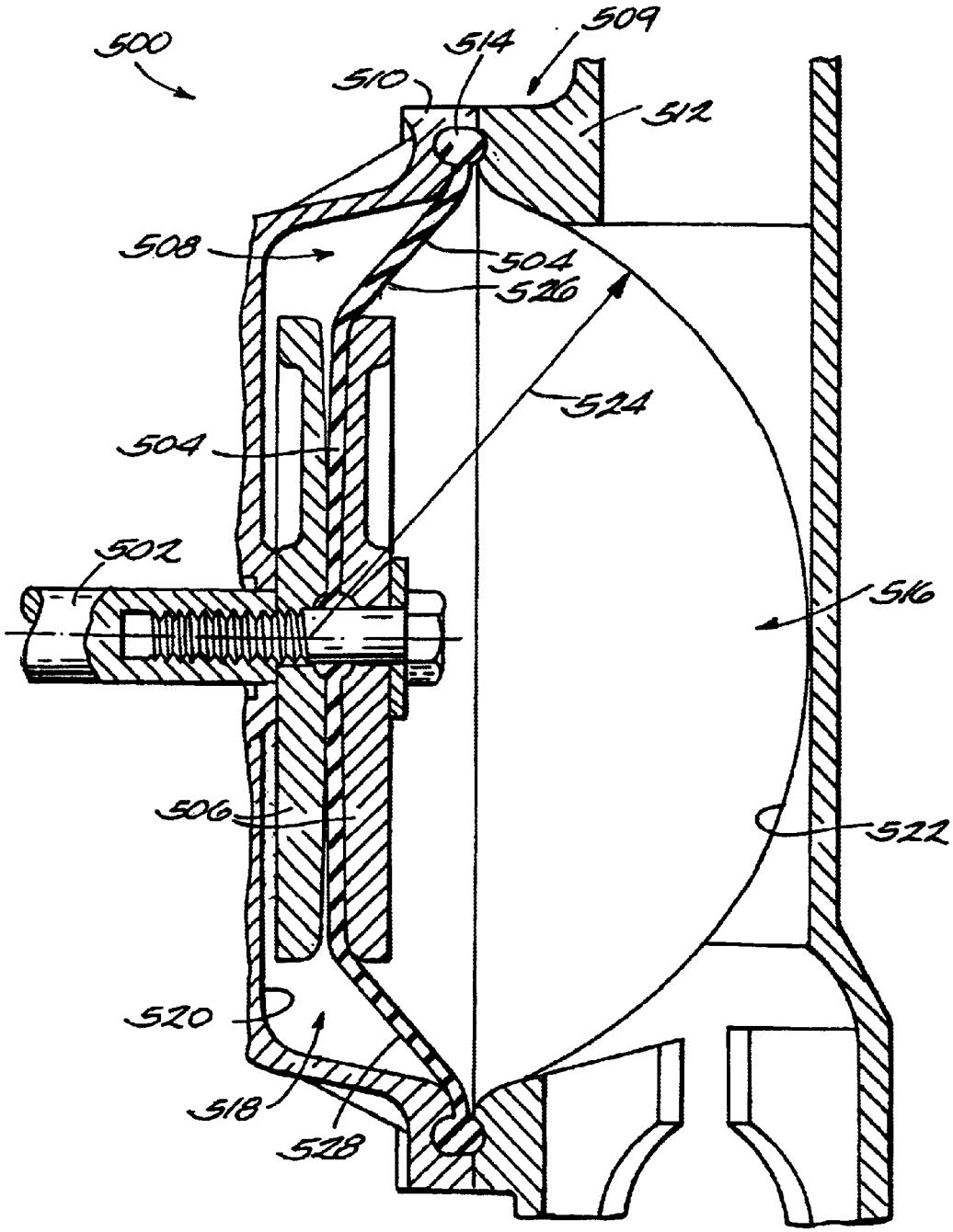
FIG. 2 illustrates the diaphragm chamber of FIG. 1 with the diaphragm in a withdrawn position.

Referring to FIGS. 1 and 2, a conventional air-operated diaphragm pump 500, as discussed in the background section above, is shown. The conventional pump 500 includes a piston 502 coupled to a diaphragm 504 using two diaphragm washers 506. The diaphragm 504 is housed in a diaphragm chamber 508 defined within a diaphragm housing 509 formed by the cooperation of an air cap 510 and fluid cap 512. A rim 514 of the diaphragm 504 is pinched between the air cap 510 and the fluid cap 512 when they are joined to form the diaphragm housing 509. FIG. 1 shows the piston 502 of the pump 500 in an extended position with the diaphragm 504 therefore pushed to an extended position within the diaphragm chamber 508. FIG. 2 shows the piston 502 of the pump 500 in a withdrawn position with the diaphragm 504 thereby pulled to a withdrawn position in the diaphragm chamber 508. While FIGS. 1 and 2 represent the diaphragm 504 in two different positions within the same diaphragm chamber 508, it will be readily understood by those of ordinary skill in the art that FIGS. 1 and 2 could also represent two different diaphragms coupled to opposite ends of the piston in a double-diaphragm pump arrangement. In this way, FIGS. 1 and 2 would represent a single state of the double-diaphragm arrangement. In other words, when one diaphragm is in the extended position as shown in FIG. 1, the diaphragm on the other end of the piston of the double-diaphragm pump arrangement would be in the position as shown in FIG. 2, as would be readily apparent to those of ordinary skill in the art.

Referring again to FIGS. 1 and 2, the diaphragm 504 divides the diaphragm chamber 508 into a fluid chamber 516 between the diaphragm 504 and the fluid cap 512, and an air chamber 518 between the diaphragm 504 and the air cap 510. As will be readily apparent to those of ordinary skill in the art, the insertion and evacuation of pressurized air into and out of the air chamber 518 causes the diaphragm 504 to move back and forth, thereby pumping fluid into and out of the fluid chamber 516. As shown in FIG. 1, with pressurized air pumped into the air chamber 518, the diaphragm 504 and piston 502 are moved to an extended position. Movement to this position forces fluid in the fluid chamber 516 to be pumped out of the fluid chamber 516. With the piston 502 and the diaphragm 504 moved to the withdrawn position as shown in FIG. 2, additional fluid is drawn into the fluid chamber 516 to be pumped out of the fluid chamber 516 when the piston 502 and the diaphragm 504 move back to their extended position as shown in FIG. 1.

As shown in both FIGS. 1 and 2, the air cap 510 is formed with an inner surface 520 and the fluid cap 512 is formed with an inner surface 522, which together define the diaphragm chamber 508. Inner surfaces 520 and 522 are formed to accommodate the range of motion of the piston 502 and the diaphragm 504 within the diaphragm chamber 508. When designing and manufacturing the conventional diaphragm pump 500, the range of motion of the diaphragm 504 is typically accommodated by forming the inner surfaces 520 and 522 by simple methods that it is hoped will permit the unrestricted motion of the diaphragm 504 when the pump 500 is actually manufactured and put to use. For example, as shown in FIGS. 1 and 2, the inner surface 522 is formed with a relatively consistent radius 524. Forming the inner surface 522 with the relatively consistent radius 524 provides for relatively easy manufacture of the fluid cap 512 and provides a shape to the inner surface 522 that it is hoped will fully accommodate the range of motion of the diaphragm 504. However, until the pump 500 is actually manufactured and used, it is not known whether the fluid cap 512 has been formed to truly accommodate the full range of motion of the diaphragm 504.

For example, an exterior surface 526 of the diaphragm 504 may actually contact the inner surface 522 of the fluid cap 512 when the piston 502 and the diaphragm 504 are in the extended position at the extent of the their stoke, as shown in FIG. 1. Additionally, when the piston 502 and the diaphragm 504 are at the extent of their stoke as shown in FIG. 1, it is desirable to have pumped as much of the fluid in the fluid chamber 516 out of the fluid chamber 516 as is possible. A large volume of unpumped fluid stagnating in the fluid chamber 516 can decrease the efficiency of the pump 500.

Similarly, the inner surface 520 of the air cap 510, while not formed with a relatively consistent radius like the inner surface 522 of the fluid cap 512, is nevertheless formed with a relatively simple shape that it is hoped will accommodate the range of motion of the diaphragm 504. However, using conventional methods of designing the typical air cap 510, the relationship between an interior surface 528 of the diaphragm 504 and inner surface 520 of the air cap 510 is not known. When the piston 502 and the diaphragm 504 are in their withdrawn position as shown in FIG. 2, the air chamber 518 may be needlessly large, which requires additional pressurized air to be pumped into the air chamber 518 to drive the piston 502 and the diaphragm 504. Again, as with the fluid chamber 516, to maximize the efficiency of the pump 500, it is desirable to evacuate as much of the air chamber 518 as possible when the diaphragm 504 is in its withdrawn position, as shown in FIG. 2.

Figure 3:
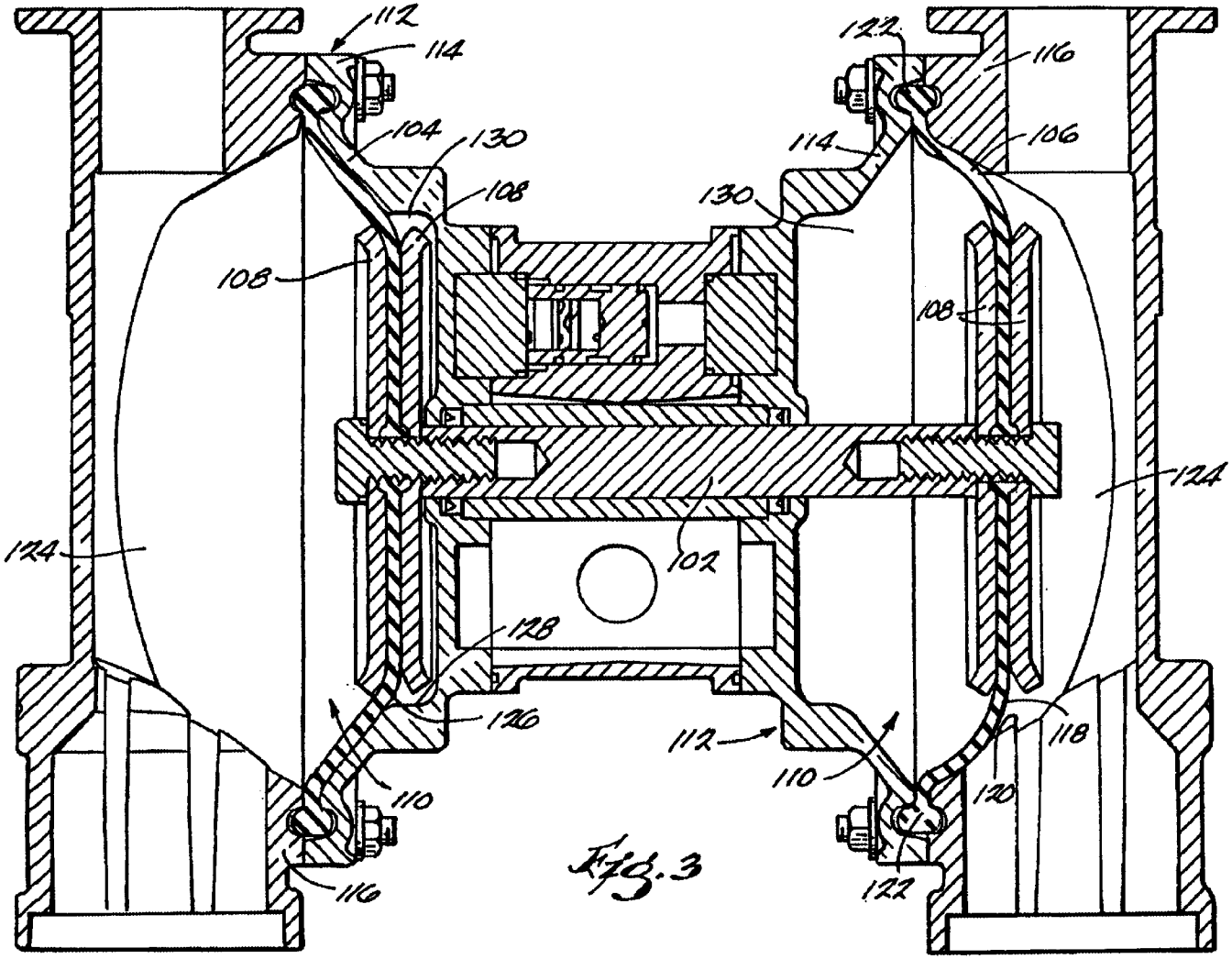
FIG. 3 illustrates a pump according to the present invention having two diaphragm chambers with a right diaphragm in an extended position, a left diaphragm in a withdrawn position, and a piston connecting the two diaphragms.

Referring now to FIG. 3, an air-operated double-diaphragm pump 100 according to the present invention includes a piston 102 coupled on either end to a first and second diaphragm 104, 106, respectively, using diaphragm washers 108. The diaphragms 104 and 106 are each contained in a diaphragm chamber 110 defined within a diaphragm housing 112 comprising an air cap 114 and fluid cap 116. Each diaphragm chamber 110 is divided into fluid chamber 124 between the fluid cap 116 and the diaphragm 104 or 106 and an air chamber 130 between the air cap 114 and the diaphragm 104 or 106. As mentioned above with regard to conventional double-diaphragm pumps, the diaphragms 104 and 106 of the double-diaphragm pump 100 operate in a reciprocating manner such that the diaphragm 104 is in a withdrawn state of its stoke when the diaphragm 106 is in an extended state of its stoke. Thus, when the diaphragm 104 is in an extended state, it will be positioned within its diaphragm chamber 110 much like the diaphragm 106 is shown positioned in its diaphragm chamber 110 in FIG. 3. Similarly, in its withdrawn state, the diaphragm 106 will be positioned much like the diaphragm 104 is shown positioned in FIG. 3.

As can be seen in FIG. 3, with the diaphragm 106 in its extended position, an exterior surface 118 of the diaphragm 106 closely follows an inner surface 120 of the fluid cap 116. The exterior surface 118 of the diaphragm 106 particularly follows the inner surface 120 of the fluid cap 116 between a rim 122 of the diaphragm 106 where the diaphragm 106 is secured between the air cap 114 and the fluid cap 116 and that portion of the diaphragm 106 that is sandwiched between the diaphragm washers 108. The remainder of the inner surface 120 of the fluid cap 116 is formed with a relatively smooth curve for ease of manufacture, but to minimize space between the inner surface 120 of the fluid cap 116 and the diaphragm 106 and diaphragm washers 108 when the diaphragm 106 is in its extended position.

To minimize the remaining volume of the fluid chamber 124 when the diaphragm 106 is in its extended position, the pump 100 and its diaphragm housings 112 have been designed and manufactured with the deformed shape of the diaphragm 106 in mind. To do this, a computer model of the diaphragm 106 is first built. The type of material to be used for the diaphragm 106 and other known parameters for the manufacture of the pump 100 are used in constructing the computer model of the diaphragm 106. Once the computer model of the diaphragm 106 is constructed, a pressure is applied to the diaphragm model to simulate the environment the diaphragm 106 will experience in the actual pump. Using a nonlinear finite element analysis (FEA) methodology, the diaphragm 106 is then analyzed to estimate the shape of the diaphragm 106 in its deformed state. For example, the shape of the diaphragm 106 in FIG. 3 is the result of performing finite element analysis on the diaphragm to estimate that its deformed shape in its extended position will be as shown in FIG. 3. The fluid cap 116 can then be designed to maximize the efficiency of the pump 112 by minimizing the volume of the fluid chamber 124 when the diaphragm 126 is in its extended position as shown in FIG. 3. Of course, manufacturing constraints may also be considered.

Alternatively, instead of using finite element analysis to estimate the deformed shape of the diaphragm 106, the diaphragm 106 could actually be placed in a test chamber and measurements could be taken to estimate the deformed shape of the diaphragm 106 when it is actually in the finished pump 100. In either case, some estimation of the deformed shape of the diaphragm 106 is used to design the diaphragm housing 112. Additionally, it will be readily apparent to those of ordinary skill in the art that the nonlinear finite analysis discussed above could alternatively have been performed without the use of a computer.

Similarly, as shown in FIG. 3, in its withdrawn state, an interior surface 126 of the diaphragm 104 closely follows an inner surface 128 of the air cap 114. This reduces the volume of the air chamber 130 created between the interior surface 126 of the diaphragm 104 and the inner surface 128 of the air cap 114. This is accomplished in the pump 100 according to the present invention by analyzing the diaphragm 104 to predict its withdrawn deformed shape and accordingly designing the diaphragm housing 112 and, particularly, the air cap 114. As with the design of the fluid cap 116, the air cap 114 is designed to fully accommodate the predicted shape of the deformed diaphragm 104. The computer model of the diaphragm 104 is constructed and placed in a non-linear FEA package with a pressure differential on one side to simulate the diaphragm shape at its most withdrawn position of the stoke. As with the design of the fluid cap 116, the path of the diaphragm 104 is documented and graphed to design and construct the air cap 114 to accommodate the full range of motion of the diaphragm 104 once placed in an actual pump. In this way, any undesirable dead space in the air chamber 130 can be eliminated to maximize efficiency, while avoiding abrasive rubbing contact between the diaphragm 104 and the inner surface 128 of the air cap 114.

As mentioned above, the diaphragm 104 could be analyzed using non-computerized means. For example, a test diaphragm could be constructed and placed in a test chamber with a pressure differential applied to it to actually measure the deformed shape of the diaphragm. Also, nonlinear finite element analysis could be performed on the diaphragm 104 to predict its deformed shape, with or without the use of a computer. In all cases, the diaphragm 104 or 106 is analyzed to predict its deformed shape in actual use to better design the diaphragm housing 112 and particularly the inner surfaces 120 and 128 of the fluid cap 116 and the air cap 114, respectively.

Although the invention has been described in detail with reference to certain described constructions, variations and modifications exist within the scope and spirit of the invention as described and defined in the following claims.

What is claimed is:

1. A method of producing a pump comprising:

selecting a diaphragm;

determining the extent to which the diaphragm will deform when pressurized in a diaphragm chamber of a pump; and designing the diaphragm chamber to house the diaphragm based on determining the extent to which the diaphragm will deform.

2. The method of claim 1, wherein the extent of diaphragm deformation is determined using finite element analysis.

3. The method of claim 2, further comprising developing a three-dimensional computer model of the diaphragm and wherein a computer program analyzes the computer model of the diaphragm to determine the extent of deformation of the diaphragm.

4. The method of claim 3, wherein the analysis of the diaphragm is performed with a differential pressure of between 5 and 25 psig applied to the diaphragm.

5. The method of claim 4, wherein the analysis of the diaphragm is performed with a differential pressure of approximately 20 psig applied to the diaphragm.

6. The method claim 1, wherein the extent of diaphragm deformation is determined by measuring the deflection of the diaphragm when a pressure differential is applied to it.

7. The method of claim 6, wherein the pressure differential applied to the diaphragm is approximately 20 psig.

8. The method of claim 1, wherein designing the diaphragm chamber comprises designing the inner surfaces of an air cap and a fluid cap, which define the diaphragm chamber.

9. The method of claim 1, wherein the diaphragm chamber includes a fluid chamber at least partially defined by the diaphragm, the diaphragm being moveably supported in the diaphragm chamber between an extended position and a withdrawn position to change a volume of the fluid chamber, and wherein the act of designing the diaphragm chamber comprises designing the fluid chamber to minimize the volume of the fluid chamber when the diaphragm is in the extended position.

10. A method of producing a pump comprising:

selecting a diaphragm;

constructing a computer model of the diaphragm;

placing the computer model of the diaphragm in a finite element analysis computer program and simulating the application of a force on the diaphragm;

determining the extent to which the diaphragm deforms in response to the application of the force on the diaphragm by running the finite element analysis computer program; and designing a diaphragm housing to house the diaphragm based on determining the extent to which the diaphragm deforms.

11. The method of claim 10, wherein designing the diaphragm housing comprises designing an air cap and a fluid cap that together comprise the diaphragm housing.

12. The method of claim 11, wherein designing the diaphragm housing comprises designing an inner surface of the air cap and an inner surface of the fluid cap.

13. The method of claim 10, wherein the force applied to the diaphragm is between 5 and 25 psig.

14. The method of claim of claim 13, wherein the analysis of the diaphragm is performed with a differential pressure of approximately 20 psig applied to the diaphragm.

15. The method of claim 10, wherein the force applied to the diaphragm is approximately 20 psig.

* * * * *